United States Patent [19]

Wood

[11] 4,068,406

[45] Jan. 17, 1978

[54] SIDE CAMMING BALANCE SPRING LOCK

[75] Inventor: Edward H. Wood, Sanford, N.C.

[73] Assignee: Jim Walter Corporation, Tampa, Fla.

[21] Appl. No.: 715,724

[22] Filed: Aug. 19, 1976

[51] Int. Cl.[2] ..... E05D 13/10; E05D 15/22

[52] U.S. Cl. ..... 49/181; 49/446; 49/453

[58] Field of Search ..... 49/181, 174, 446, 453

[56] References Cited

U.S. PATENT DOCUMENTS

| | | | |
|---|---|---|---|
| 3,434,236 | 3/1969 | Weidner et al. | 49/181 X |
| 3,482,354 | 12/1969 | Trout | 49/446 X |
| 3,611,636 | 10/1971 | Trout | 49/181 |
| 3,789,549 | 2/1974 | Yip | 49/181 |

*Primary Examiner*—Philip C. Kannan

*Attorney, Agent, or Firm*—Schroeder, Siegfried, Ryan, Vidas and Steffey

[57] ABSTRACT

A side camming balance spring lock adapted to be slidably mounted in a jamb channel of a window frame which incorporates slidably mounted camming members in the side of the same operated through flat and curved surfaces on a shaft to effect the locking action. The shaft includes a notch in which the connecting pin for the sash is positioned to effect rotation of the shaft on tilt out of the sash for the locking function. A removable plug closes an aperture in the lock above the shaft notch in which the balance spring connection is positioned. Removal of the plug permits removal of the sash from the lock as well as the disconnection of the balance spring therefrom.

8 Claims, 4 Drawing Figures

SIDE CAMMING BALANCE SPRING LOCK

This invention relates to a side camming balance spring lock applied to pivoted sash type windows and more particularly to a simplified lock construction applicable to metal or wooden windows.

The simplified side camming lock of the present invention is an improvement over the constructions shown in the L. E. Peters et al U.S. Pat. No. 3,055,062, on a PIVOTED SASH TYPE WINDOW, dated Sept. 25, 1962, L. E. Peters U.S. Pat. No. 3,055,063 for a PIVOTED SASH TYPE WINDOW dated Sept. 25, 1962 and L. E. Peters U.S. Pat. No. 3,146,501, on the SIDE CAMMING BALANCE SPRING LOCK dated Sept. 1, 1964. In each of these prior construction showing balance spring locks, the lock structure must have particular dimensions to meet the dimensional requirements of the particular sash and frame to which it is applied in order to perform the locking or wedging function. Similarly, these lock designs seem to be limited or restricted to particular shapes of weather stripping to retain the lock member and balance spring therein. In addition, the coupling of the balance spring to the lock requires removal of the lock structure from the jamb channel before a balance spring may be repaired or replaced. These prior balance spring lock designs all require a particular notched configuration in the lintels of the sash to couple the sash to the lock mechanism. This restricts the application of the lock structures shown in the patents to particular types of windows.

The improved side camming lock structure of the present invention performs the camming function in such a manner that it is not restricted to a particular dimension of jamb width or opening in weather stripping to accommodate the lock member. The balance spring lock employs a block member which is of a standard size for all types of windows and which utilizes a side camming member or members as a separate part thereof which may be constructed to any particular length to fit varying size jambs and effect a frictional lock therebetween. Further, this balance spring lock utilizes a shaft member to which the sash is coupled through a pin or key which is insertable into the shaft member of the lock at a slot therein to operate the lock. The pin or key may be connected to any shape or configuration of sash or material used in the construction of the sash without requiring a special sash configuration or design. Further, the lock includes a removable plug which is designed to secure the end of the balance spring or a sash cord of a balance spring assembly to the lock. The plug upon removal permits lift out separation of the sash from the lock or separation of the balance spring from the lock without disassembly of the lock. Thus, the sash to which the improved lock is applied may be readily removed from the window casing in this manner. Similarly, the balance spring or spring assembly may be readily disconnected from the lock for change or repair in the same manner.

It is therefore an object of this invention to provide an improved side camming balance spring lock which is applicable to all types of sliding and tilt out sash windows.

Another object of this invention is to provide an improved balance spring lock which permits easy disconnect of the balance spring from the lock for change or repair.

Another object of this invention is to provide an improved balance spring lock in which the sash may be made removable by a simple removal of a retaining plug.

A still further object of this invention is to provide an improved balance spring lock which incorporates a separate camming member, or members, enabling the utilization of different sized camming members to accommodate varying jamb dimensions.

A still further object of this invention is to provide an improved balance spring lock of a side camming type which is easy to install.

These and other objects of the invention will become apparent from a reading of the attached description together with the drawings wherein.

Figure 1:
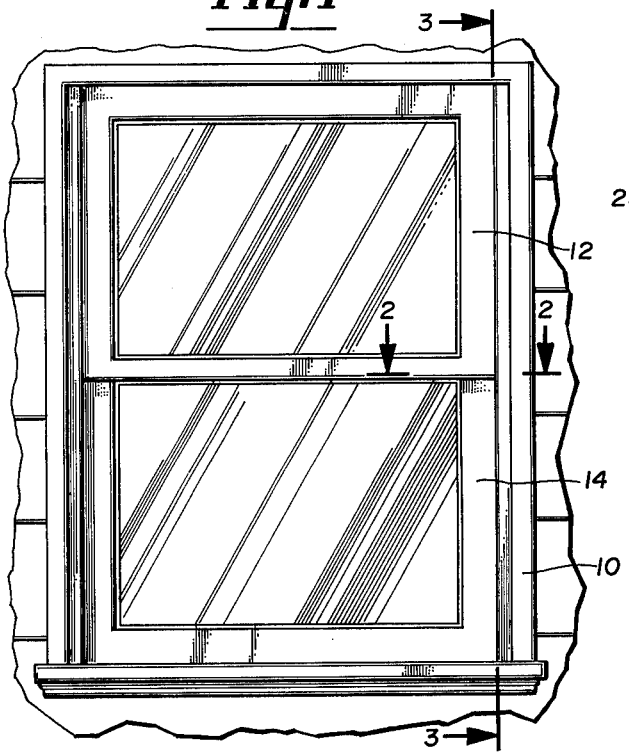
FIG. 1 is an elevation view of a window with which the present invention is employed.

FIG. 1 shows schematically a conventional double hung window to which an improved balance spring lock of the present invention is applied. It will be understood, however, that single hung windows or windows of either metal or wood construction may readily employ the present invention. Thus, in FIG. 1, the window frame is indicated generally at 10 as mounting sash 12 and 14 which sash slide vertically in separate jamb channels within the window frame. It will be understood that balance spring assemblies are positioned on each side of the sash in the respective jamb channels and coupled to the lintels of the sash to apply the balance spring tension thereto. It will also be understood that the sash width and frame width dimensions are such that weather stripping would be employed in the jamb channels to permit tilt of the sash within the window frame. For simplicity, only a single balance spring assembly and side camming balance spring lock is shown in FIG. 3, and it will be understood that these assemblies and locks are included on each side of the sash and for each sash in a double hung window.

Figure 2:
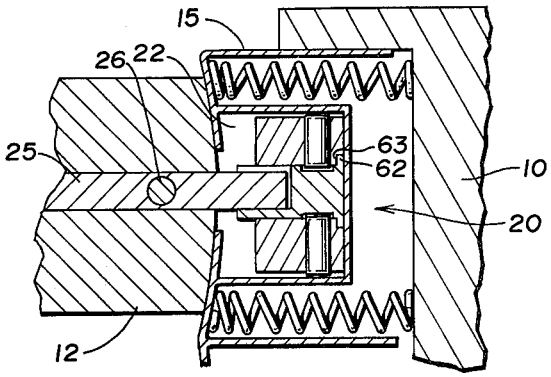
FIG. 2 is a cross sectional view taken along the lines 2—2 in FIG. 1.

In FIG. 2, the bottom or lintel of the sash shown broken away at 12. It is slidably mounted in one channel of the window frame to which suitable weather stripping 15 is positioned. The sash 12 is connected to the balance spring, lock indicated generally at 20, through a pin or key member, indicated at 25, which is secured to the bottom edge or lintel of the sash adjacent a side stile and projecting into the jamb channel. The pin may be secured to the sash through suitable screw means 26 and it is normally square or rectangular in cross section so as to fit into a similarly shaped notch in the lock as will be later identified. In FIG. 2 the weather stripping is shown as having a recessed surface 22 in which is positioned the balance spring and lock. Depending upon the configuration of the weather stripping, the balance spring assembly and lock may be positioned to contact the jamb channel in the window frame directly.

Figure 3:
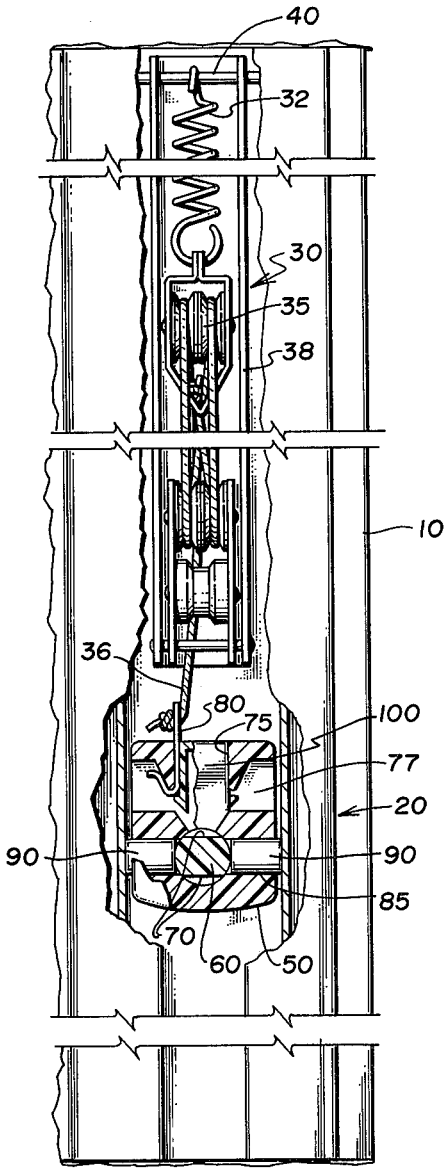
FIG. 3 is a cross sectional view taken along the lines 3—3 of FIG. 1; and, FIG. 4 is an exploded view of the parts of the balance spring lock.

The sectional view of FIG. 3 is broken away to show only a single channel of the window frame, with the remaining channel and window stripping being broken for simplicity. The balance spring 30 is shown as a balance spring assembly which includes a spring 32, pulley system 35, and sash cord 36 all housed in a single channel support structure 38 which is secured in the jamb channel through a suitable hook, not shown, clipped around a retaining shaft or pin 40 in the housing. It will be understood that this assembly may be replaced by a helical spring or the equivalent tension spring to be attached to the lock and apply the bias to the sash. The balance spring assembly 30 is positioned in the channel 22 of the weather stripping 15 with the sash cord 36 extending to the balance spring lock 20 which is slidably mounted in the channel or opening 22 in the weather stripping.

Figure 4:
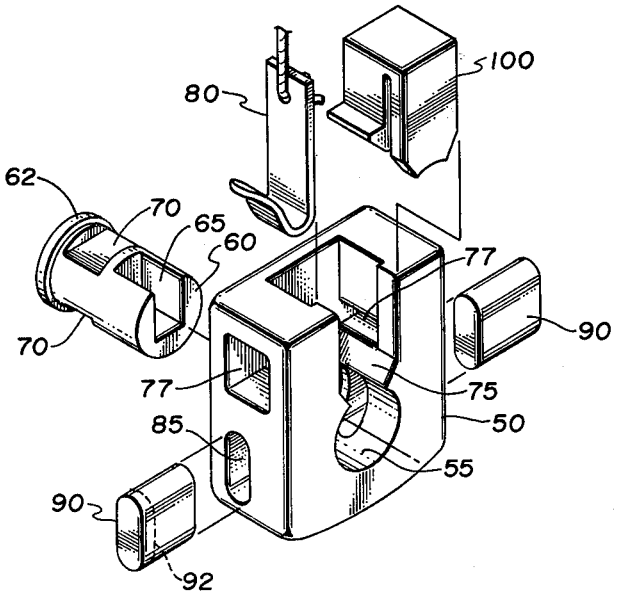

The balance spring lock is shown in FIG. 4 in exploded view to indicate the parts of the same. It will be seen that it incorporates a block, indicated at 50, which is generally rectangular in cross section and is preferably made of a plastic material which is relatively slidable in the jamb channel. The block 50 has a aperture or hole 55 extending from the back face to the front face of the block which is slightly offset from the geometric center of the block. Positioned in this cylindrical recess or aperture is a shaft member 60 which shaft member includes an annular collar portion 62, which rides in an annular recess 63 on the back face of the block. The shaft member has a length greater than the block thickness so as to extend through and project from the front face of the block. Shaft member 60 has a rectangular notch 65 extending from the end opposite of the collar substantially on half of the entire length of the same. At least one flat surface 70 is machined in the shaft member intermediate between the notch and the collar. Block 50 also includes a first recessed surface 75 extending from the front and top surfaces of the block and communicating with the aperture of hole 55 partially along the extent of the same. On either side of the block are positioned recess latch surfaces 77 which are adapted to receive and hold a clip member 80 to which a sash cord or the end of a spring may be attached. The block 50 also has a aperture or hole 85 positioned on one or both sides of the block and extending translationally through the block aligned with the axis of the aperture 55 from the side or sides to the aperture 55. A camming member 90 or camming members 90 are positioned in the aperture or apertures 85 in the block. Each camming member has the same cross sectional dimension as the aperture 85 in which it is mounted and it is slidably mounted therein to extend from the opening 55 beyond the side surfaces of the block. The shaft member 60 preferably has its flat surfaces 70 aligned with the open and closed sides of the notche 65 or on diametrically opposed surfaces and between the notch and the collar. The apertures 85 in the sides of the block are offset from its geometrically center to align with flat surfaces on the shaft member. In one condition of rotation of the shaft member, each camming member 90 will engage a flat surface on the shaft member, and upon rotation of the shaft member due to tilt of the window, a curved surface will be encountered moving the camming member 90 translationally in the block so that the end of the same will project from the sides of the block. This end or ends, if two camming members are used, will engage a side wall of the channel in the weather stripping or in the jamb itself, depending upon the weather stripping configuration, to effect a braking or locking action of the block in the jamb channel. With the block locked or braked, the tension of the balance spring on the sash is removed. Thus, the tilt of the window sash through a 90° rotation locks the balance spring so that the sash may be held in a tilted position without vertical movement. It will be understood that depending upon the width of the jamb channels, one or two cam members 90 may be employed and the individual camming members may be of different lengths depending upon the effective width of the jamb channel in which the block is slidably positioned to effect the locking action. Preferably the lock is constructed with two flat surfaces 70 the centers of which are oriented 90° from the centers of the curved surfaces on the shaft member 60 and aligned with the extent of the notch so that they may be interchanged on opposite sides of the sash. It also enables the open face of the slot 65 in the shaft member to be common to the recess 75 in the tilt or locked position of the window sash so that the pin 25 resting in the slot 65 and attached to the sash may be lifted out of the slots and the sash removed from the lock if desired.

The balance spring lock also includes a plug member 100 which has the same cross sectional shape as the recess 75. It is adapted to be positioned in recess 75 from the top surfaces of the block and held in position by friction clamping the clip 80 in the catch 77 of the recess and closing the recess 75 and the exposed opening of the shaft aperture 55. This removable plug permits ease in installation by allowing the sash with the pin attached thereto to be dropped into the slot 65 in the shaft member of the lock through the recess 75 and to be secured therein by the addition of the plug 100. Whenever it is desired to either remove the spring or replace it for repair, the plug 100 may be removed from the block in the tilt position of the window through a suitable hook or catch member, not shown, lifting the same out of the recess 75 and exposing the clip 80 attached to the spring for release from the latch surface 77. Similarly, the sash may be removed in the same manner.

The improved side camming balance spring lock may be used in varying sized window jambs or with varying weather stripping configurations because of the variable expansion of the same. This is accomplished by providing one or two camming members in the lock and the selection of the desired length of the camming members. In FIG. 4, and at phantom at 92, there is an indication that the camming members may be selected in varying lengths to be positioned in the apertures 85 in the block. The simplified balance spring lock permits the attachment of any type of balance spring to block through a suitable clip which is retained in the block by means of a removable plug 100 enabling interchange of springs without disassembling the windows for maintenance and repair. Similarly, the removal of the plug permits the tilt out window to have the take out feature.

Therefore, in considering the invention it should be remembered that the disclosure is illustrative only, and the scope of the invention should be determined by the appended claims.

I claim:

1. A side camming balance spring lock for use in a jamb of a vertical channel window comprising, a block slidably positioned in each jamb and adapted to slide therein, said block having a cylindrical aperture therethrough extending from a back to a front surface of the block, a cylindrical shaft having an annular collar at one end of the same bearing against the back surface of the block and "U" shaped notch extending from the other end of the shaft and exposed on the front surface of the block, said shaft having at least one flat surface extending axially of the block and intermediately the extent of the shaft, a first recess in the block extending from the top of the block to the cylindrical aperture, a second recess in the block extending from a side surface of the block to the cylindrical aperture, a camming member slidably mounted in the second recess and having a length longer than the second recess and adapted to be contacted by the flat and cylindrical surfaces of the shaft upon rotation of the shaft in the cylindrical aperture, a notched surface in the side of the first recess adapted to receive a clip to be connected to a balance spring, said "U" shaped notch in the shaft being adapted to receive a key attached to a sash which upon tilt of the sash from the jamb rotates the shaft to project the camming member out of the side of the block and against the wall of the jamb, and plug means removably mounted in the first recess to secure the clip in the notched surface of the recess and close the communication of the "U" shaped notch in the shaft of the block.

2. A side camming balance spring lock of claim 1 in which the block is made of a plastic material.

3. The side camming balance spring lock of claim 1 in which the first recess and plug means are wedged shaped in form.

4. The side camming balance spring lock of claim 3 in which the plug is insertable in to the recess at the top of the block.

5. The side camming balance spring lock of claim 1 in which the second recess in the block and the camming member have similar and cooperating cross sections permitting sliding movement of said camming member in the second recess.

6. The side camming balance spring lock of claim 1 in which the second recess is a pair of recesses positioned on each side of the block with camming members positioned therein and projecting from the pair of recesses with rotation of said shaft.

7. The side camming balance spring lock of claim 1 in which the camming member in the second recess is separate from the block and may be constructed in different lengths.

8. A side camming balance spring lock for use in a jamb of a vertical channel window comprising, a block slidably positioned in each jamb and adapted to slide therein, said block having a cylindrical aperture therethrough extending from a back to a front surface of the block, a cylindrical shaft having a notch extending from one end of the shaft and exposed on the front surface of the block, said shaft having at least one flat surface extending axially of the block and intermediately the extent of the shaft, a first recess in the block extending from the top of the block to the cylindrical aperture, a second recess in the block extending from a side surface of the block to the cylindrical aperture, a camming member slidably mounted in the second recess and having a length longer than the second recess and adapted to be contacted by the flat and cylindrical surfaces of the shaft upon rotation of the shaft in the cylindrical aperture, a notched surface in the side of the first recess adapted to receive a clip to be connected to a balance spring, said notch in the shaft being adapted to receive a key attached to a sash which upon tilt of the sash from the jamb rotates the shaft to project the camming member out of the side of the block and against the wall of the jamb, and plug means removably mounted in the first recess to secure the clip in the notched surface of the recess and close the communication of the notch in the shaft of the block.

* * * * *